US009375967B2

(12) United States Patent
Toles et al.

(10) Patent No.: US 9,375,967 B2
(45) Date of Patent: Jun. 28, 2016

(54) PRINT MEDIA COATING

(75) Inventors: Christopher Arend Toles, Escondido, CA (US); Janne Lehtimaki, Lohja (FI)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/370,693

(22) PCT Filed: Jan. 13, 2012

(86) PCT No.: PCT/US2012/021225

§ 371 (c)(1),
(2), (4) Date: Jul. 3, 2014

(87) PCT Pub. No.: WO2013/105971

PCT Pub. Date: Jul. 18, 2013

(65) Prior Publication Data

US 2014/0356555 A1 Dec. 4, 2014

(51) Int. Cl.

| | |
|---|---|
| ***B41M 5/00*** | (2006.01) |
| ***B41M 5/52*** | (2006.01) |
| ***B05D 5/04*** | (2006.01) |

(52) U.S. Cl.

CPC ..... *B41M 5/5218* (2013.01); *B05D 5/04* (2013.01); *B41M 5/5245* (2013.01); *B41M 5/5254* (2013.01)

(58) Field of Classification Search

CPC .... B41M 5/5218; B41M 5/5254; B41M 5/52; B41M 5/5245; B05D 5/04

USPC ..... 428/32.3, 32.28

See application file for complete search history.

(56) References Cited

U.S. PATENT DOCUMENTS

| | | | |
|---|---|---|---|
| 2,814,550 | A | 11/1957 | Gunderman et al. |
| 4,289,332 | A | 9/1981 | Kato |
| 7,910,182 | B2 | 3/2011 | Baker |
| 2002/0052439 | A1 | 5/2002 | Farooq |
| 2004/0189778 | A1 | 9/2004 | Stork et al. |
| 2005/0206705 | A1 | 9/2005 | Ma et al. |
| 2006/0001725 | A1 | 1/2006 | Nagata et al. |
| 2010/0112245 | A1 | 5/2010 | Nakano |
| 2010/0279079 | A1 | 11/2010 | Campbell et al. |
| 2011/0014402 | A1 | 1/2011 | Choi et al. |
| 2011/0050827 | A1 | 3/2011 | Romano, Jr. et al. |
| 2011/0104410 | A1 | 5/2011 | Toles et al. |

FOREIGN PATENT DOCUMENTS

| | | |
|---|---|---|
| CN | 101626903 A | 1/2010 |
| JP | 2009178881 | 8/2009 |
| JP | 2011132648 | 7/2011 |
| WO | WO-2011159274 | 12/2011 |

OTHER PUBLICATIONS

IP Australia, Australian Patent Application No. 2012364893, Patent Examination Report No. 3; Sep. 4, 2015; 4 pages.

*Primary Examiner* — Betelhem Shewareged
(74) *Attorney, Agent, or Firm* — Fabian VanCott

(57) ABSTRACT

An inkjet printing media, comprising a coating layered on at least one side of the media, the coating comprising a source of polyvalent ions and a latex binder that forms a coherent film in the presence of the polyvalent ions. A coating comprising calcium 2+ ions ($Ca^{2+}$) and a latex binder that forms a coherent film in the presence of the calcium 2+ ions ($Ca^{2+}$). A print media coating comprising: a source of polyvalent ions; and a latex binder that forms a coherent film in the presence of the polyvalent ions.

20 Claims, 5 Drawing Sheets

PRINT MEDIA COATING

RELATED APPLICATIONS

The present application claims the priority under 35 USC 371 of previous International Patent Application No. PCT/US2012/021225, filed Jan. 13, 2012, entitled "Print Media Coating," which is incorporated heroin by reference in its entirety.

BACKGROUND

Types of media used in printing may comprise a percentage of divalent or polyvalent cations mixed into a coating that is later coated over the media. The divalent or polyvalent cations may be added to provide a level of ink bleed control. However, the addition of the divalent or polyvalent cations may interfere with a binder film formation. This may cause the binder to be relatively more susceptible to damage caused by water or wet surfaces. In some cases, handling the printed media with human hands may cause fingerprints or palm prints to show up in the finished product resulting in an inferior product.

BRIEF DESCRIPTION OF THE DRAWINGS

The accompanying drawings illustrate various examples of the principles described herein and are a part of the specification. The examples do not limit the scope of the claims.

Throughout the drawings, identical reference numbers designate similar, but not necessarily identical, elements.

DETAILED DESCRIPTION

Figure 1:
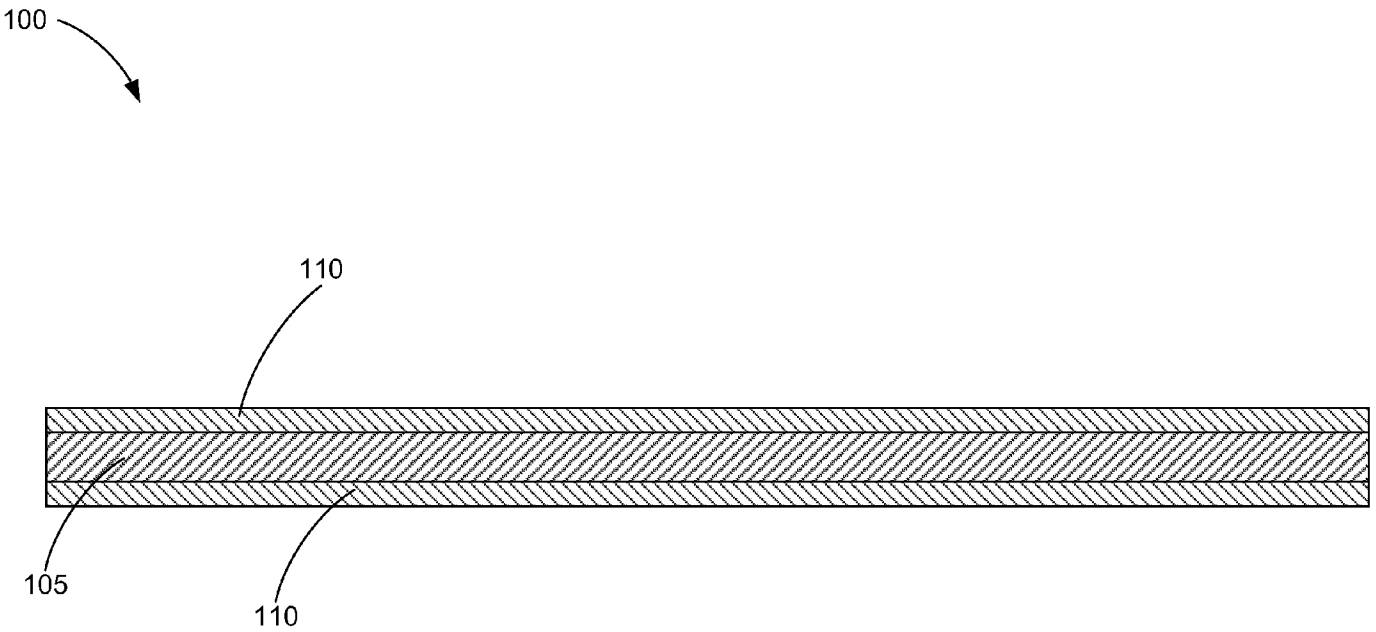
FIG. 1 is a cross-sectional diagram of a printing media according to one example of the principles described herein.

As described above, various types of printing media may contain chemicals that provide a source of polyvalent cations. One example of a polyvalent cation is calcium 2+ ($Ca^{2+}$). These polyvalent cations may be provided by, for example, calcium chloride ($CaCl_2$). Polyvalent cations such as calcium 2+ ($Ca^{2+}$) may be added to a coating mixture or slurry to control the ink bleeding in the media. Specifically, the polyvalent cations may serve to flocculate the ink pigments on the surface of the media during printing. Consequently, the polyvalent cations prevent color-to-color bleed, loss of gamut and lowered optical density of the printed product.

A binder package may also be added to the coating slurry to bind the components into a coherent coating. Some binders, such as polyvinyl alcohol, may be too water soluble in coating formulations. This may be also true where a crosslinker such as boric acid cannot be used due to the relatively high pH level (i.e. pH>7). Addition of a water-soluble or water dispersible binder such as polyvinyl alcohol may result in wet durability issues. For example, when ink is jetted onto the surface of the coated media, introduction of water will result in a distortion of the image printed on the media. As the operators of the printing device handle the printed product, sweat from their hands may be enough to remove the ink and coating layer off of the media.

A latex binder may be added to the coating to supplement or replace the polyvinyl alcohol. The latex binder, when heated during the drying process of the media, coalesces and acts to bind the coating together. However, in the presences of some polyvalent cations, the latex binder may fail to create a sufficiently durable coating. Failure of the latex binder to form a sufficiently durable coating in the presence of calcium 2+ ions ($Ca^{2+}$) may be due to an intolerant functional group on the latex particles, a calcium 2+ ion ($Ca^{2+}$) intolerant dispersant suspending the latex particles, a calcium 2+ ion ($Ca^{2+}$) intolerant additive in the latex formulation, or other calcium 2+ ion ($Ca^{2+}$) intolerant chemicals within the latex formulation.

In the present specification and in the appended claims, the term "polyvalent cation" is meant to be understood broadly as any cation that that can form more than one valence bond with another element or molecule. In one example, a polyvalent cation used in the formation of the coating on the media is calcium 2+ ($Ca^{2+}$). In this example, the calcium 2+ ($Ca^{2+}$) cations may be provided to the formulation via the inclusion of calcium chloride ($CaCl_2$).

In the present specification and in the appended claims, the components of any formulations are expressed in terms of dry parts, with the total dry parts of dry inorganic pigments in a given formulation set to 100 dry parts. Other coating components are expressed in parts as a ratio to 100 parts of inorganic pigment.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language indicates that a particular feature, structure, or characteristic described in connection with that example is included as described, but may not be included in other examples.

FIG. 1 is a cross-sectional diagram of a printing media (100) according to one example of the principles described herein. As mentioned above the printing media (100) comprises a supporting substrate (105) and a coating (110). In one example, the printing media (100) may be coated with the coating (110) on both the top and bottom sides. Both sides of the media may be coated so that both sides may receive a printed image or for convenience of insertion of the printing media into the printing device. Additionally, in one example the thickness of the coating may be 7-10 μm thick. In some examples, the coating may be deposited onto the surface of the printing media at 10 gramps per square meter using a coater such as a blade coater.

The supporting substrate (105), on which the coating (110) formulation is applied, may take the form of a sheet or a continuous web suitable for use in an inkjet printer. The supporting substrate (110) may be a base paper manufactured from cellulose fibers. More specifically, the base paper may be produced from chemical pulp, mechanical pulp, thermal mechanical pulp and/or the combination of chemical and mechanical pulp. The base paper may also include additives such as internal sizing agents and fillers. The internal agents are added to the pulp before it is converted into a paper web or substrate. As a non-limiting example, the fillers may be selected from calcium carbonate ($CaCO_3$), talc, clay, kaolin, titanium dioxide ($TiO_2$) and combinations thereof. Other applicable substrates include cloth, nonwoven fabric, felt, and synthetic (non-cellulosic) papers. The supporting substrate may be an uncoated raw paper or a pre-coated paper. In addition, the base paper may be calendered or uncalendered.

The coating (110) may comprise a precipitated calcium carbonate (PCC), a ground calcium carbonate (GCC), a modified calcium carbonate (MCC), a latex, a polyvinyl alcohol (PVA), calcium chloride ($CaCl_2$), a wax emulsion, a defoamer, an optical brightening agent, and a dye. Examples of the formulation of the coating (110) will now be described in more detail below. In one example, a clay pigment or any inorganic pigment may also be added to the formulation in addition to or in place of some or all of the precipitated calcium carbonate (PCC) or modified calcium carbonate (MCC).

The modified calcium carbonate (MCC) material may take the form of a slurry dispersion of structured calcium minerals, which may be comprised of calcium carbonate ($CaCO_3$), calcium phosphate, calcium silicate ($Ca_2SiO_4$), or combinations thereof. Calcium phosphate includes compounds containing calcium ions together with phosphate ions, and may include, but is not limited to, octacalcium phosphate ($Ca_8H_2(PO_4)_6\text{-}5H_2O$). A non-limiting example of modified calcium carbonate is Omyajet® 5020 available from Omya Inc. In one example, the total amount of modified calcium carbonate present in the coating composition is between 10 and 30 dry parts. In another example, the total amount of modified calcium carbonate present in the coating composition is 20 dry parts.

The precipitated calcium carbonate (PCC) material may also take the form of a slurry dispersion of structured calcium minerals. A non-limiting example of precipitated calcium carbonate (PCC) is Opacarb® A40 available from Specialty Mineral Inc. In one example, the total amount of precipitated calcium carbonate (PCC) present in the coating composition is between 90 to 70 dry parts. In another example, the total amount of precipitated calcium carbonate (PCC) present in the coating composition is 80 dry parts.

The coating composition may further include a polyvinyl alcohol (PVA) as a rheology controller and a carrier for any optical brightening agents added to the formulation or as an additional binder. In one example, the polyvinyl alcohol (PVA) may have a relatively low molecular weight with a relatively medium hydrolysis. In another example, the polyvinyl alcohol (PVA) may have a relatively high molecular weight with a relatively high highdrolysis. Non-limiting examples of a polyvinyl alcohol (PVA) that may be added to the coating formulation may comprise PVA BF-5 available from Chang Chun Petrochemical Co., Ltd. and Mowiol® 15-99 available from Kuraray America, Inc. In one example, the total amount of polyvinyl alcohol (PVA) present in the coating composition is between 0 and 7 dry parts. In another example, the total amount of polyvinyl alcohol (PVA) present in the coating composition is between 0.1 and 1 dry parts. In yet another example, the total amount of polyvinyl alcohol (PVA) present in the coating composition is 0.5 dry parts. In still another example, the total amount of polyvinyl alcohol (PVA) present in the coating composition is between 1 and 3 dry parts. In a further example, the total amount of polyvinyl alcohol (PVA) present in the coating composition is 2 dry parts.

The coating composition may further comprise calcium chloride ($CaCl_2$). As briefly discussed above, the calcium chloride ($CaCl_2$) may be added in preparation for the printing media (100) to receive an ink. The calcium chloride ($CaCl_2$) servers to flocculate ink pigments deposited on the surface of the printing media (100). Flocculation of the ink pigments prevents color-to-color bleed, loss of gamut, and lowered optical density of the print. In one example, the total amount of calcium chloride ($CaCl_2$) present in the coating composition is between 8 and 10 dry parts. In another example, the total amount of calcium chloride ($CaCl_2$) present in the coating composition is 9 dry parts.

Other ingredients in the coating formulation may also include a wax emulsion. A non-limiting example of a wax emulsion that may be added to the coating formulation is Ultralube® E846 available from Keim-Additec. In one example, the total amount of wax emulsion present in the coating formulation may be between 1 and 1.6 dry parts. In another example, the total amount of wax emulsion present in the coating formulation may be 1.8 dry parts.

The coating formulation may further include an optical brightening agent. A non-limiting example of an optical brightening agent that may be added to the coating formulation is Leucophor® available from Clariant International Ltd. In one example, the total amount of optical brightening agent present in the coating composition is between 0.1 and 1.8 dry parts. In another example, the total amount of optical brightening agent present in the coating composition is 0.1 dry parts. In yet another example, the total amount of optical brightening agent present in the coating composition is 1.8 dry parts.

Still further, the coating formulation may include a defoamer. A non-limiting example of a defoamer that may be added to the coating formulation is Agitan® 103 available from MUNZING CHEMIE GMBH. In one example, the total amount of defoamer present in the coating composition is between 0.2 and 0.3 dry parts. In another example, the total amount of defoamer present in the coating composition is 0.25 dry parts.

Even further, the coating formulation may include one or more types of clay pigments. The clay may be selected from the group consisting of calcined clay, kaolin clay, phyllosilicates, silica, aluminum trihydroxide, alumina, boehmite, pseudoboehmite, among others.

Various dyes may also be added to the coating formulation. A non-limiting example of a dye is Violet Carteren® available from Clariant Ltd. In one example the total amount of dye present in the coating composition is 0.007 dry parts.

The coating (110) may also comprise a latex. The latex may be any form of latex that may form a coherent film in the presence of polyvalent cations present in the coating formulation. In one example, the latex may be any form of latex that forms a coherent film in the presence of calcium 2+ ions. The calcium 2+ ions ($Ca^{2+}$) may be provided by the calcium chloride ($CaCl_2$) described above. A non-limiting example of a latex that may be added to the coating formulation is XZ 96750 available from Styron Suomi Oy. In one example the total amount of latex present in the coating composition is between 5 to 15 dry parts. In another example, the total amount of latex present in the coating composition is between 7 and 10 dry parts. In yet another example, the total amount of latex present in the coating composition is 9 dry parts. In still another example, the total amount of latex present in the coating composition is 8 dry parts.

As previously discussed, polyvinyl alcohol may be used as a binder in the presence of calcium ions (Ca2+). However, polyvinyl alcohol is a water-soluble binder. After a coating (110) containing polyvinyl alcohol as a binder is dried and used in an inkjet printing system, the introduction of water onto the surface of the printed media (100) will not form a water resistant or water insoluble film to protect the printed surface. This may be especially true where the pH levels of the coating formulation is greater than 7 thereby preventing the use of boric acid as a cross linker in the formulation.

The latex binder in the present formulation may therefore serve as a water-insoluble binder preventing the printed image from being damaged in the presence of water. The latex binder may further be polyvalent ion tolerant such that the latex may form the water-insoluble film in the presence of the polyvalent ions. Specifically, the latex binder may be calcium ion ($Ca^{2+}$) tolerant such that the latex may form the water-insoluble film in the presence of the calcium ions ($Ca^{2+}$) present from the calcium chloride ($CaCl_2$) added to the formulation.

In one example of the present application, the latex binder may comprise a dispersant or other additive added during the manufacturing process of the latex dispersion The dispersant or additive may be used to suspend the latex colloidal particle in water. Additionally, the dispersant or additive may have a functional group such as a carboxylate group (COO—) that is pendant off of the latex particle and which has a chemical affinity to the polyvalent ions in the coating formulation such as calcium 2+ ($Ca^{2+}$). When the coating is dried after application to the printing media (100), a coherent film is formed which will stand up to the application of water.

In some examples, the latex binder may be comprised of latices that include monomers such as styrene ($C_6H_5CH{=}CH_2$):

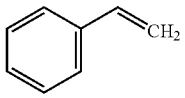

styrene 1,3-butadiene ($C_4H_6$):

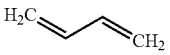

1,3-butadiene acrylonitrile ($C_3H_3N$):

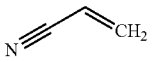

acrylonitrile or combinations thereof. Specifically, in some examples, the latex binder may include latices such as styrene butadiene rubber (SBR), styrene-(butyl) acrylate (S(B)A), polyvinylacetates (PVAc), or combinations thereof.

In one example the coating formulation may comprise the ingredients as represented in the following table (Table 1):

TABLE 1

| Component | Dry Parts |
|---|---|
| Opacarb A40 | 80 |
| Omyajet 5020 | 20 |

TABLE 1-continued

| Component | Dry Parts |
|---|---|
| XZ 96750 Latex | 9 |
| PVA BF-5 | 0.5 |
| $CaCl_2$ | 9 |
| Ultralube E846 | 1.8 |
| Agitan 103 Defoamer | 0.25 |
| Optical Brightening Agent (OBA) | 0.1 |
| Dye | 0.007 |

The above coating formulation described in table 1 may have a total percent of solids of 42.0 and a pH of 8.1.

Figure 2:
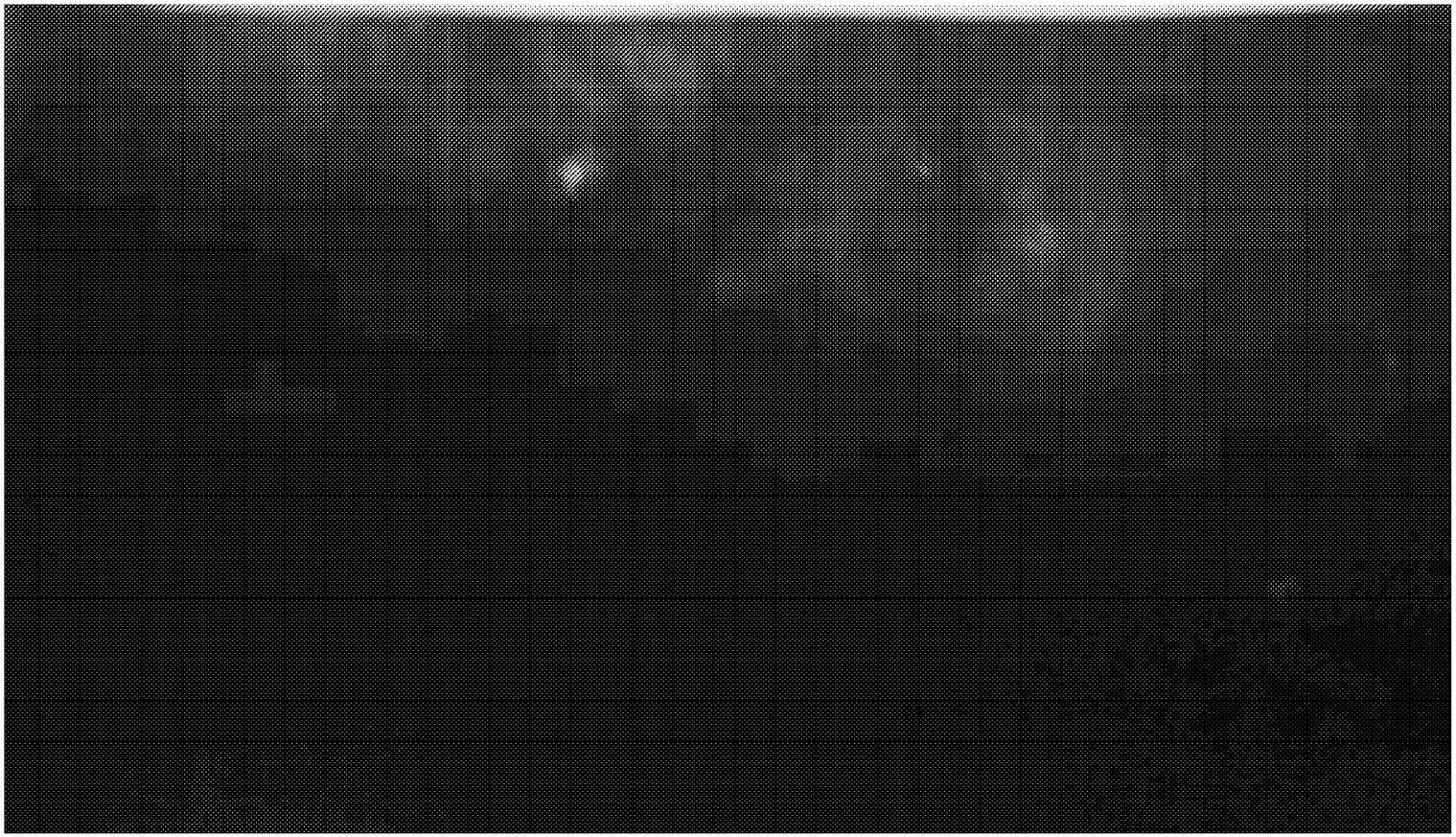
FIG. 2 is an image of a printing media having a coating according to one example coating formulation of the present specification that has been subjected to a fingerprint test according to one example of principles described herein.

A fingerprint test was conducted using the above formulation described in Table 1. The fingerprint test comprises placing a portion of the printing media on a foam backing after it has received an image from a printing device. A tester's finger is then moistened with tap water and any excess water is dabbed off using a dry paper towel. The tester then presses firmly onto the printing media just until the foam backing deforms. The finger is then removed and an analysis is made as to whether any damage can be seen. FIG. 2 is an image of such a fingerprint test as applied to the formulation described above in Table 1. As can be seen from the test, the formulation described in Table 1 has prevented the latex coating from being removed in the presence of water.

In another example, the coating formulation may comprise the ingredients as represented in the following table (Table 2):

TABLE 2

| Component | Dry Parts |
|---|---|
| Opacarb A40 | 80 |
| Omyajet 5020 | 20 |
| XZ 96750 Latex | 8 |
| Mowiol 15-99 (PVOH) | 2 |
| $CaCl_2$ | 9 |
| Ultralube E846 | 1.8 |
| NaOH | 0.1 |
| Agitan 103 Defoamer | 0.25 |

The above latices were tested to determine if they could develop a coherent film in the presence of a polyvalent cation such as calcium 2+ ($Ca^{2+}$). First, the calcium salt (i.e., $CaCl_2$) was added to the latex followed by other components of the formulation as described above. The mixture was vigorously mixed for 15 minutes. After mixing, approximately 15 mL of the resulting slurry was placed in the bottom of a small aluminum pan such that the slurry covered the bottom of the pan. The film pan was baked in an oven at 110° F. for approximately 20 minutes so that the moisture was driven off. The pan was then removed from the heat and allowed to acclimate for approximately 24 hours. To test the strength of the resulting film, a 10 mL aliquot of deionized (DI) water was added. Those latices which form a coherent film as opposed to isolated flocs and which stand up to the addition of water after the coating formulation has been allowed to dry and set are used as a latex binder for the present formulation.

Figure 3:
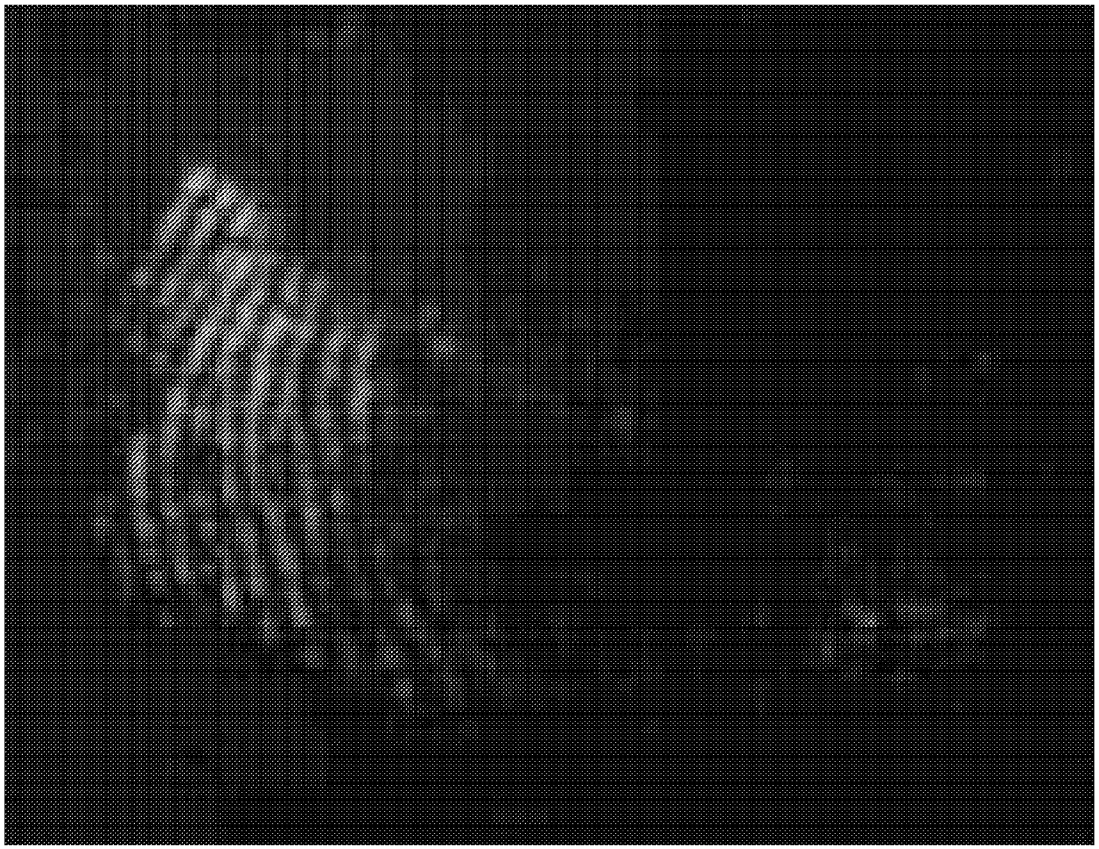
FIG. 3 is an image of a printing media having a coating according to another example coating formulation of the present specification that has been subjected to a fingerprint test according to one example of principles described herein.

FIG. 3 is an image of a fingerprint test as described above and as applied to the formulation described above in Table 2. As can be seen from the test, the formulation described in Table 2 has prevented most of the latex coating from being removed in the presence of water.

In yet another example, the coating formulation may comprise the ingredients as represented in the following table (Table 3):

TABLE 3

| Component | Dry Parts |
|---|---|
| Opacarb A40 | 80 |
| Omyajet 5020 | 20 |
| XZ 96750 Latex | 9 |
| Mowiol 15-99 (PVOH) | 2 |
| $CaCl_2$ | 4.5 |
| Ultralube E846 | 1.8 |
| Leucophor (optical brightening agent) | 0.5 |
| Dye | 0.005 |
| Agitan 103 Defoamer | 0.35005 |

Figure 4:
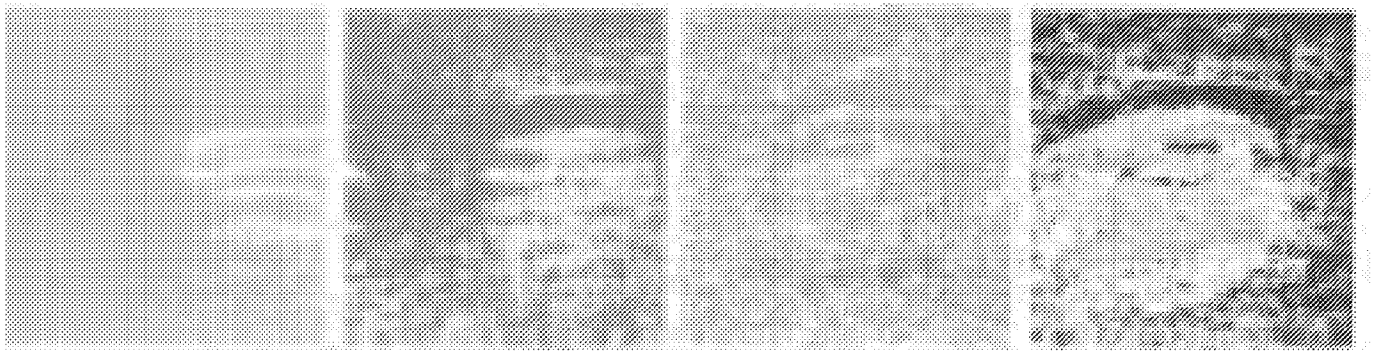
FIG. 4 is an image of a printing media having a coating according to another example coating formulation of the present specification that has been subjected to a wet rub test according to one example of principles described herein.

The coating formulation above was tested to determine if it could develop a coherent film in the presence of a polyvalent cation such as calcium 2+ ($Ca^{2+}$). Specifically, a wet rub test was initiated to determine if the coating could stand up in the presence of water. First, the printing media (FIG. 1, 100) receives an image via an inkjet printing device. 50 μL of deionized water is then placed on the printing media (FIG. 1, 100). The water is allowed to sit for 30 seconds. A Sutherland tester equipped with a texwipe and a 2 lb. weight is used to wipe the print for 5 cycles back-and-forth. FIG. 4 is an image of the wet rub test performed on the printing media (FIG. 1, 100) having a coating according to the formulation described above in Table 3.

For a comparative example, a coating formulation was prepared comprising the ingredients as represented in the following table (Table 4):

| Component | Dry Parts |
|---|---|
| Opacarb A40 | 80 |
| Omyajet 5020 | 20 |
| Styronal D628 Latex | 9 |
| Mowiol 15-99 (PVOH) | 2 |
| $CaCl_2$ | 4.5 |
| Ultralube E846 | 1.8 |
| Leucophor (optical brightening agent) | 0.5 |
| Dye | 0.005 |
| Agitan 103 Defoamer | 0.35005 |

Figure 5:
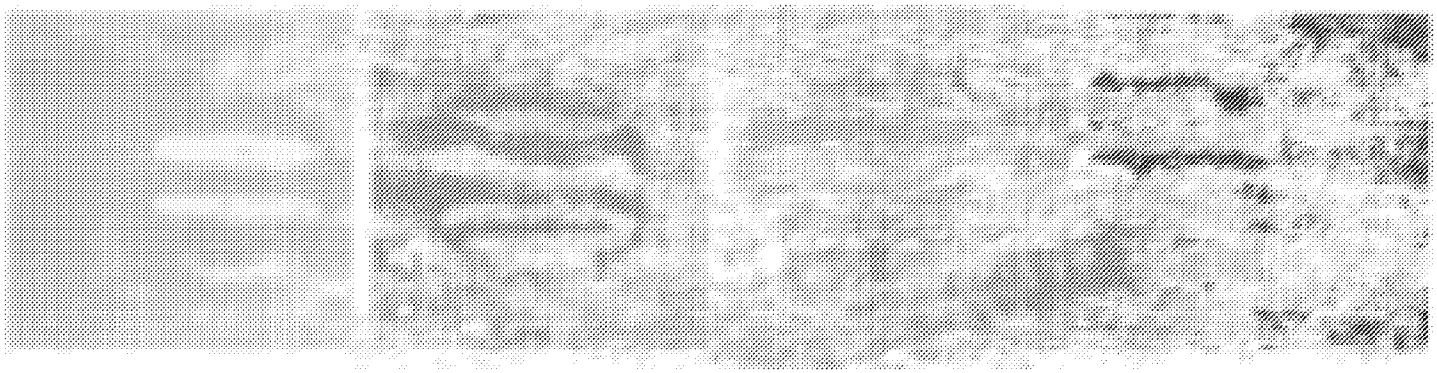
FIG. 5 is a comparative image of a printing media having a coating according to one comparative example coating formulation that has been subjected to a wet rub test according to one example of principles described herein.

FIG. 5 is an image of the wet rub test performed on the printing media (FIG. 1, 100) having a coating according to the formulation described above in Table 4.

As can be seen in a comparison of FIG. 4 to FIG. 5, the Styronal® D628 available from BASF SE provides a less durable and coherent film compared to the XZ 96750.

The specification and figures describe an inkjet printing media. The inkjet printing media includes a source of polyvalent ions such as calcium 2+ ($Ca^{2+}$) which is used to flocculate ink particles as they are received onto the surface of the media. The media further includes a latex binder that forms a coherent film in the presence of the polyvalent ions. This inkjet printing media may have a number of advantages, including flocculation of ink particles on the surface of the media combined with the improved wet durability of the latex binder.

The preceding description has been presented to illustrate and describe examples of the principles described. This description is not intended to be exhaustive or to limit these principles to any precise form disclosed. Many modifications and variations are possible in light of the above teaching.

What is claimed is:

1. An inkjet printing media comprising:

a coating layered on at least one side of the media, the coating comprising:

greater than 70 dry weight percent pigment, the pigment comprising:

modified calcium carbonate; and processed calcium carbonate;

5.5 to 8.5 dry weight percent water soluble polyvalent metal ion compound; and 4 to 9 dry weight percent latex binder, wherein the latex binder forms a coherent film in the presence of the polyvalent ions, and wherein the polyvalent ions are calcium 2+ ions.

2. The inkjet printing media of claim 1, in which the latex binder comprises a dispersant added to the latex binder during the manufacturing process of the latex binder in which the dispersant has a chemical affinity to the polyvalent ions.

3. The inlet printing media of claim 1, in which the latex binder comprises styrene monomers, I,3-butadiene monomers, acrylonitrite monomers, or combinations thereof.

4. The inkjet printing media of claim 1, in which the latex binder comprises styrene butadiene, styrene-(Butyl) acrylate, polyvinylacetates, or combinations thereof.

5. The inkjet printing media of claim 1, in which the latex binder comprises latex particles that comprise polyvalent ion compatible functional groups.

6. The inkjet printing media of claim 1, in which the coating further comprises a polyvinyl alcohol and in which the coating comprises 0 to 6.5 dry weight percent polyvinyl alcohol.

7. The inkjet printing media of claim 3, in which the water soluble polyvalent metal ion compound is calcium chloride ($CaCl_2$).

8. A print media coating comprising:

a source of polyvalent ions;

a latex binder that forms a coherent film in the presence of the polyvalent ions;

a pigment comprising greater than 70 dry weight percent of the coating, the pigment comprising:

modified calcium carbonate; and processed calcium carbonate;

5.5 to 8.5 dry weight percent water soluble polyvalent metal ion compound; and a dye.

9. The print media coating of claim 8, in which the latex binder comprises styrene monomers 1,3-butadiene monomers, acrylonitrile monomers, or combinations thereof.

10. The print media coating of claim 8, in which the latex binder comprises styrene butadiene, styrene-(Butyl) acrylate, polyvinylacetates, or combinations thereof.

11. The print media coating of claim 8, in which the latex binder comprises a dispersant added to the latex during the manufacturing process of the latex.

12. The print media coating of claim 9, in which the source of polyvalent ions is calcium chloride ($CaCl_2$).

13. A method of forming an inkjet printing media, the method comprising:

applying a coating to at least one side of the media, the coating comprising:

4 to 9 dry weight percent latex binder, wherein the latex binder forms a coherent film in the presence of polyvalent ions, and wherein the polyvalent ions are calcium 2+ ions;

5.5 to 8.5 dry weight percent water soluble polyvalent metal ion compound; and greater than 70 dry weight percent pigment, the pigment comprising:

modified calcium carbonate; and processed calcium carbonate; and drying the coating to form a coherent film.

14. The method of claim 13, in which the water soluble polyvalent metal ion compound is calcium chloride ($CaCl_2$).

15. The method of claim 13, in which the formulation further comprises a wax emulsion and the latex binder is formed from monomers comprising: styrene monomers; 1,3-butadiene monomers; acrylonitrile monomers; or combinations thereof.

16. The inkjet printing media of claim 1, in which the coating further comprises a dye.

17. The inkjet printing media of claim 1, in which the coating is formed from a solution with a pH greater than 7.

18. The inkjet printing media of claim 1, in which the coating further comprises:

a defoamer;
a brightening agent;
a wax emulsion; and
a dye.

19. The print media coating of claim 12, further comprising:

a defoamer;
a brightening agent;
a wax emulsion; and
polyvinyl alcohol.

20. The method of claim 14, in which the formulation further comprises a wax emulsion.

* * * * *